US007191722B1

(12) United States Patent
Plost

(10) Patent No.: US 7,191,722 B1
(45) Date of Patent: Mar. 20, 2007

(54) BOAT DRAIN PLUG ABSENCE DETECTOR

(76) Inventor: Gerald N. Plost, 3459 S. Florence Pl., Tulsa, OK (US) 74105

( * ) Notice: Subject to any disclaimer, the term of this patent is extended or adjusted under 35 U.S.C. 154(b) by 0 days.

(21) Appl. No.: 11/050,896

(22) Filed: Feb. 4, 2005

(51) Int. Cl.
*B63B 13/00* (2006.01)

(52) U.S. Cl. ..... 114/197

(58) Field of Classification Search ..... 114/197
See application file for complete search history.

(56) References Cited

U.S. PATENT DOCUMENTS 5,162,793 A 11/1992 Plost et al.
5,182,556 A 1/1993 Plost et al.
5,966,080 A * 10/1999 Bigsby ..... 340/686.4

* cited by examiner

*Primary Examiner*—Sherman Basinger
(74) *Attorney, Agent, or Firm*—Frank J. Catalano

(57) ABSTRACT

For indicating the absence of a drain plug from a boat drain when the boat is in a launch condition, a receptacle with a water flow passage and a cavity containing a Hall effect switch is mounted in the boat drain. A stopper has a magnet which operatively aligns with the Hall effect switch when the stopper plugs the passage. The Hall effect switch and a switch operated in response to a presence-of-water condition are components of a control circuit which drives a switch to connect and disconnect an audio alarm activation device to and from an electrical power source. The alarm will always be activated when the stopper is not in the drain and the presence-of-water switch has operated and will never be activated when the stopper is in the drain.

14 Claims, 4 Drawing Sheets

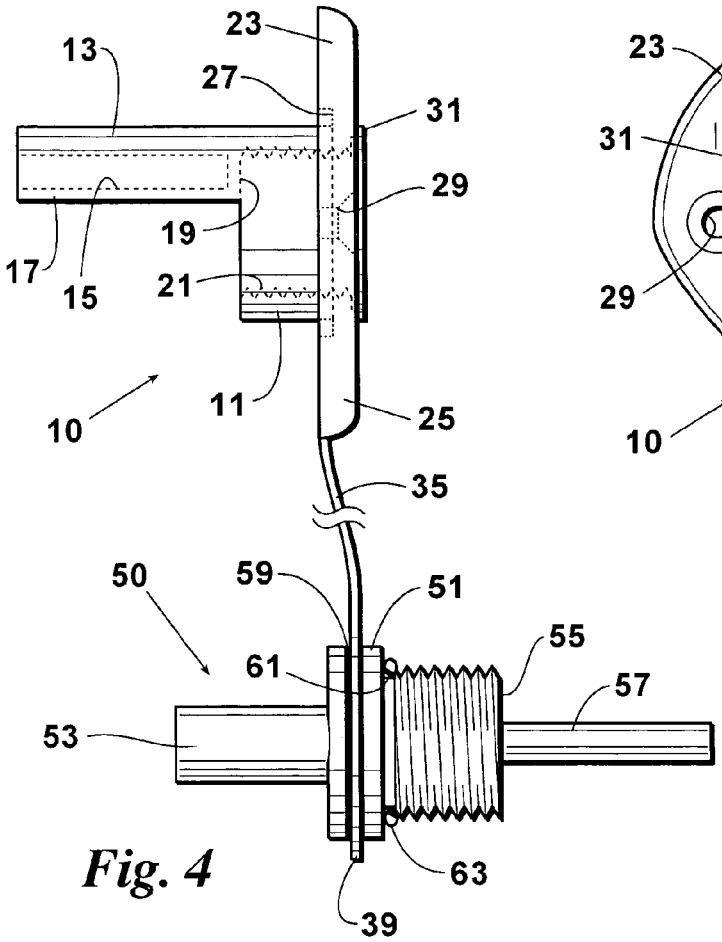
Fig. 4
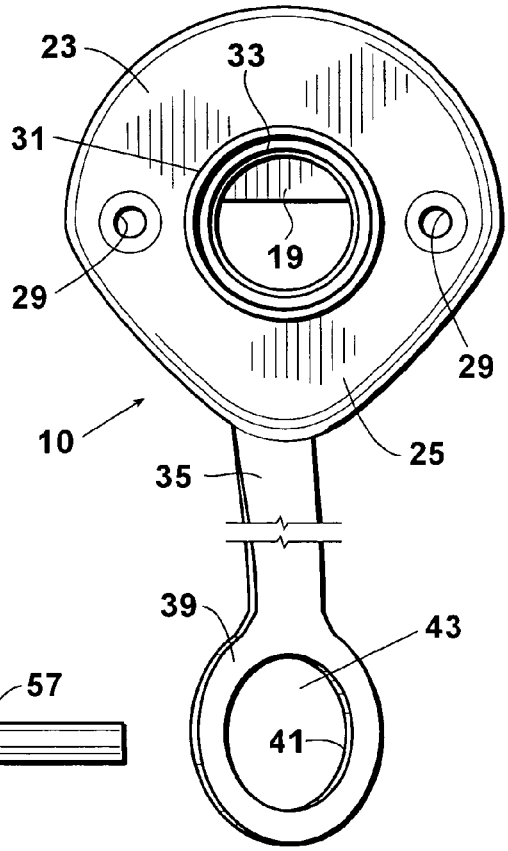
Fig. 5
Fig. 8
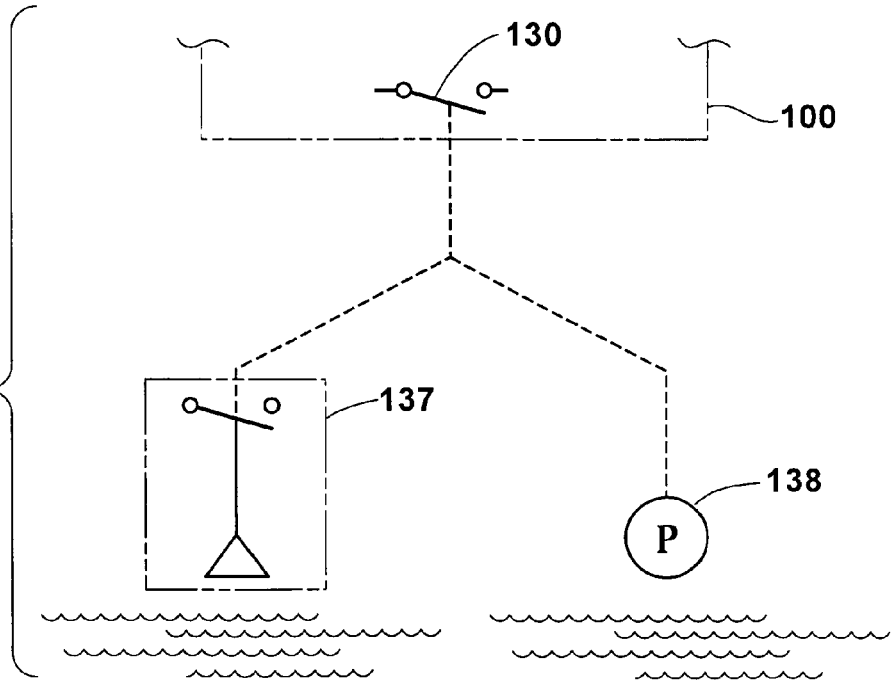

BOAT DRAIN PLUG ABSENCE DETECTOR

BACKGROUND OF THE INVENTION

This invention relates generally to accessories for water craft and more particularly concerns devices for signaling the absence of a drain plug from a boat drain when the boat is in a launch condition.

In my U.S. Pat. Nos. 5,162,793 and 5,182,556, drain plug absence indicators are disclosed which employ a stopper which is directly plugged into the boat drain (including any tube used to finish the drain) and a Hall effect switch or magnetic reed switch which is part of a control circuit contained in a housing which is mounted on the boat independently of the stopper. A pivoting latching mechanism on the stopper has a magnet which automatically operatively aligns with the Hall effect switch when the stopper is locked into the boat drain. While these devices work effectively, they do have some shortcomings.

Consistent proper operation requires that the control circuit housing be mounted precisely in a position in which the magnet will be operatively aligned with the Hall effect switch when the stopper is locked in the drain hole. Accuracy in mounting is complicated because the housing is independently mounted on the boat and radially spaced from the drain. Consequently, the location of the housing must be either be precisely measured and marked and the housing accurately held in place, a potential hit-or-miss operation, or the separate stopper and housing simultaneously held in place during the mounting process, typically a two person procedure. Even if the housing is correctly located, since the Hall effect switch is radially displaced in relation to the drain the stopper must be correctly angularly oriented in the drain on every use in order to operatively align the magnet. Furthermore, since the plug is independent of both the housing and the drain, the plug may easily be lost.

It is, therefore, an object of this invention to provide a device for signaling the absence of a drain plug which is self-aligning during the mounting process. Another object of this invention is to provide a device for signaling the absence of a drain plug which is properly aligned regardless of the angular orientation of the stopper in the drain. A further object of this invention is to provide a device for signaling the absence of a drain plug in which the Hall effect switch is not radially displaced from the drain. Yet another object of this invention is to provide a device for signaling the absence of a drain plug in which the plug is not detached from the device. It is also an object of this invention to provide a device for signaling the absence of a drain plug which can be installed by one person.

SUMMARY OF THE INVENTION

In accordance with the invention, a device is provided for indicating the absence of a drain plug from a boat drain when the boat is in a launch condition. A receptacle is insertable into the drain. The receptacle has a water flow passage and a cavity containing a Hall effect switch or magnetic reed switch. A stopper is insertable into the passage to prevent flow of water through the passage. The stopper has a magnet oriented for operative alignment with the Hall effect switch when the stopper is fully inserted into the passage.

Preferably, the control circuit of which the Hall effect switch is a component is contained in the cavity and the control circuit further includes a switch operated in response to a presence-of-water condition. The control circuit drives a switch to connect and disconnect an audio alarm activation device to and from an electrical power source so that the activation device is in an out-of-connection condition when the stopper is fully inserted into the drain and in an in-connection condition when the stopper is not fully inserted into the drain and the presence-of-water switch has operated. Preferably, the activation device is a relay.

Preferably, the receptacle has a cylindrically tubular water flow passage, a chordal tubular cavity with a wall separating the passage from the cavity and a flange about the cylindrically tubular passage adapted to abut the boat when the receptacle is fully inserted into the drain, the flange having an annular pocket adapted to abut the drain when the receptacle is fully inserted into the drain.

Preferably, the stopper has a cylindrical plug insertable into the passage, the magnet is a rod which extends coaxially from one end of the plug, the plug has a concentrically larger disc at its other end with a finger grip extending in a direction opposite to the plug and the plug and passage are threadedly engagable.

Preferably, the receptacle is attached to one end of a strap, the stopper is attached to the other end of the strap and at least a portion of the strap is sufficiently flexible to permit the stopper to be inserted into and removed from the receptacle.

BRIEF DESCRIPTION OF THE DRAWINGS

Other objects and advantages of the invention will become apparent upon reading the following detailed description and upon reference to the drawings in which:

FIG. 4 is a side elevation view of the detector of FIG. 1 with the stopper out of the receptacle;

FIG. 5 is a rear elevation view of the detector of FIG. 1 with the stopper removed from the stopper-receptacle connecting strap;

FIG. 8 is a schematic diagram of the external components of the control circuits of FIG. 7.

Figure 1:
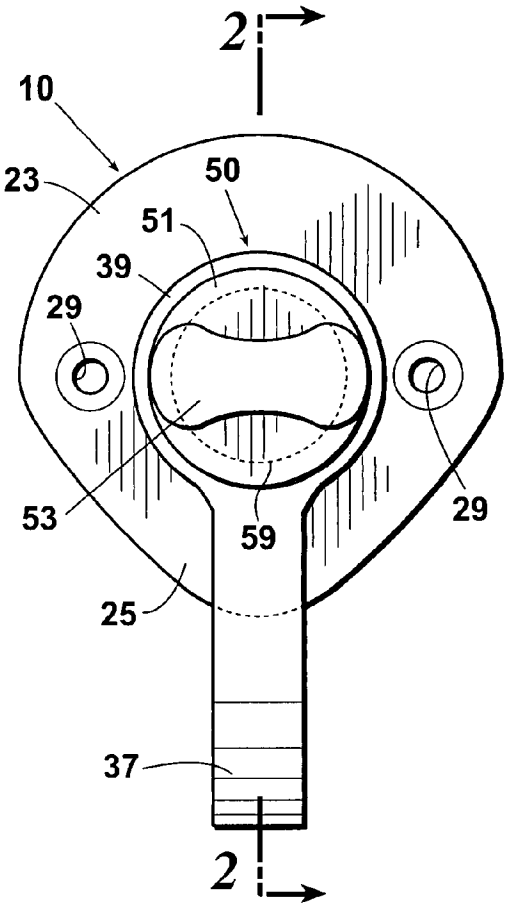
FIG. 1 is a rear elevation view of a preferred embodiment of the drain plug absence detector with the stopper in the receptacle.
Figure 2:
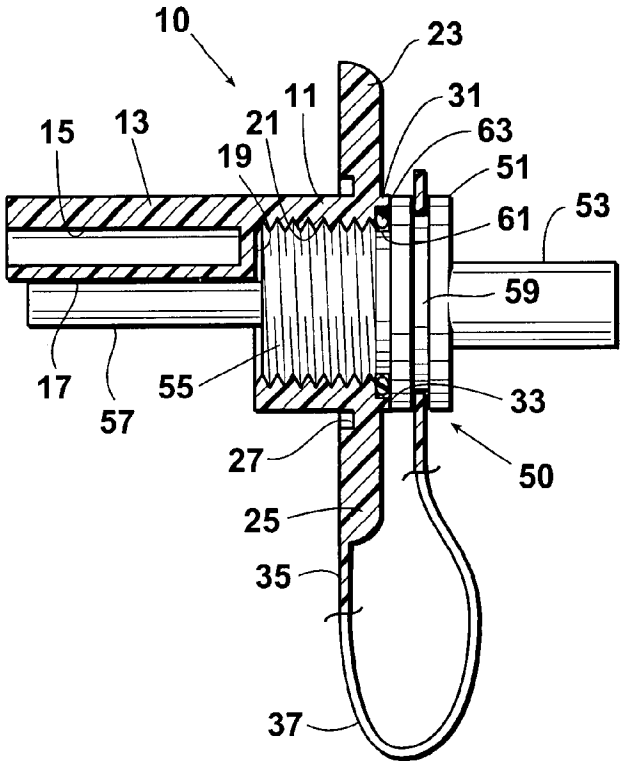
FIG. 2 is a cross-sectional view taken along the line 2—2 of FIG. 1.
Figure 3:
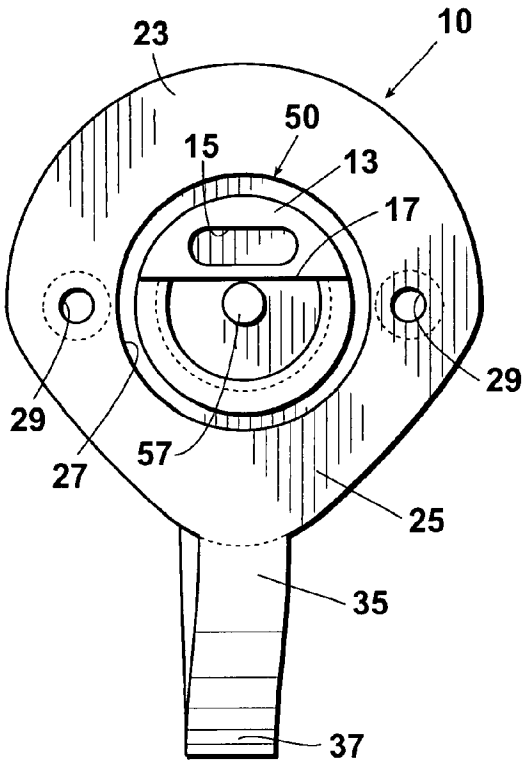
FIG. 3 is a front elevation view of the detector of FIG. 1.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Looking at FIGS. 1–8, a device is illustrated for indicating the absence of a drain plug from the drain D of a boat when the boat is being launched. The device includes a receptacle 10 which is inserted into the drain D and permanently secured to the boat, a stopper 50 which is insertable to plug the receptacle 10 and a control circuit 100 disposed in the receptacle 10 and responsive to the stopper's presence in and absence from the receptacle 10.

The receptacle 10 is preferably a unitary plastic component with a cylindrical passage or opening 11 through which water can pass when the receptacle 10 is mounted in the drain D. The opening 11 shown is defined by a cylindrical tube. A housing 13 in the receptacle 10 forms a cavity 15 to contain the control circuit 100. As shown, the housing 13 extends forwardly (in relation to the boat orientation) from the top of the cylindrical opening 11 and has a lower horizontal chordal wall 17 defining a chordal tubular cavity 15. However, the housing 13 can extend from any part of the forward circumference of the opening 11. The rear of the housing 13 is separated from the forward end of the opening 11 by an end wall 19 so that there is no direct communication between the opening 11 and the cavity 15. The inside wall 21 of the opening 11 is threaded to receive the stopper 50. The rear outside wall of the opening 11 has an annular flange 23 which abuts the stern S of the boat when the receptacle 10 is fully inserted into the drain D. The flange 23 has a tapered portion 25 at the bottom. An annular pocket 27 is provided in the flange 23 along the circumference of the outer wall of the receptacle 10. The pocket 27 is filled with a silicon sealer (not shown) which abuts the stern S to reduce the possibility of water seeping between the receptacle 10 and the drain D. Holes 29 extend through the flange 23 to receive screws 65 which fasten the receptacle 10 to the stern S. An annular boss 31 surrounds an O-ring seat 33 along the rear rim of the opening 11 into the receptacle 10. As best seen in FIG. 5, an integral strap 35 extends from the perimeter of the flange 23, preferably from the bottom of its tapered portion 25. As best understood by comparing FIGS. 2 and 4, at least a portion 37 of the strap 35 is flexible and the free end of the strap 35 has an annular ring 39 with a tongue 41 defining a circular aperture 43 to hold the stopper 50.

The stopper 50 is preferably a unitary plastic component including a disc 51 with a grip 53 on the rear face of the disc 51 and a threaded cylindrical plug 55 extending from the front of the disc 51. An elongated magnet 57, preferably a magnetic rod which extends coaxially forwardly from the plug 55, is oriented to operatively align with a Hall effect switch 140 in the cavity 15 when the plug 55 is fully inserted or engaged in the passage 11. The disc 51 has an annular groove 59 which receives the tongue 41 of the stop ring 39 so that the strap 35 couples the stopper 50 to the receptacle 10. The disc 51 freely rotates in the aperture 43 so that, when the strap 35 is flexed to align the plug 55 with the receptacle opening 11, the plug 55 can be threaded into the opening 11. Preferably, the disc 51 is concentrically larger than the plug 55 and the plug 55 has an annular groove 61 holding an O-ring 63 against the front of the disc 51. When the plug 55 is fully threaded into the receptacle opening 11, the O-ring is compressed in the O-ring seat 33 inside the receptacle boss 31 to seal the connection.

Figure 7:
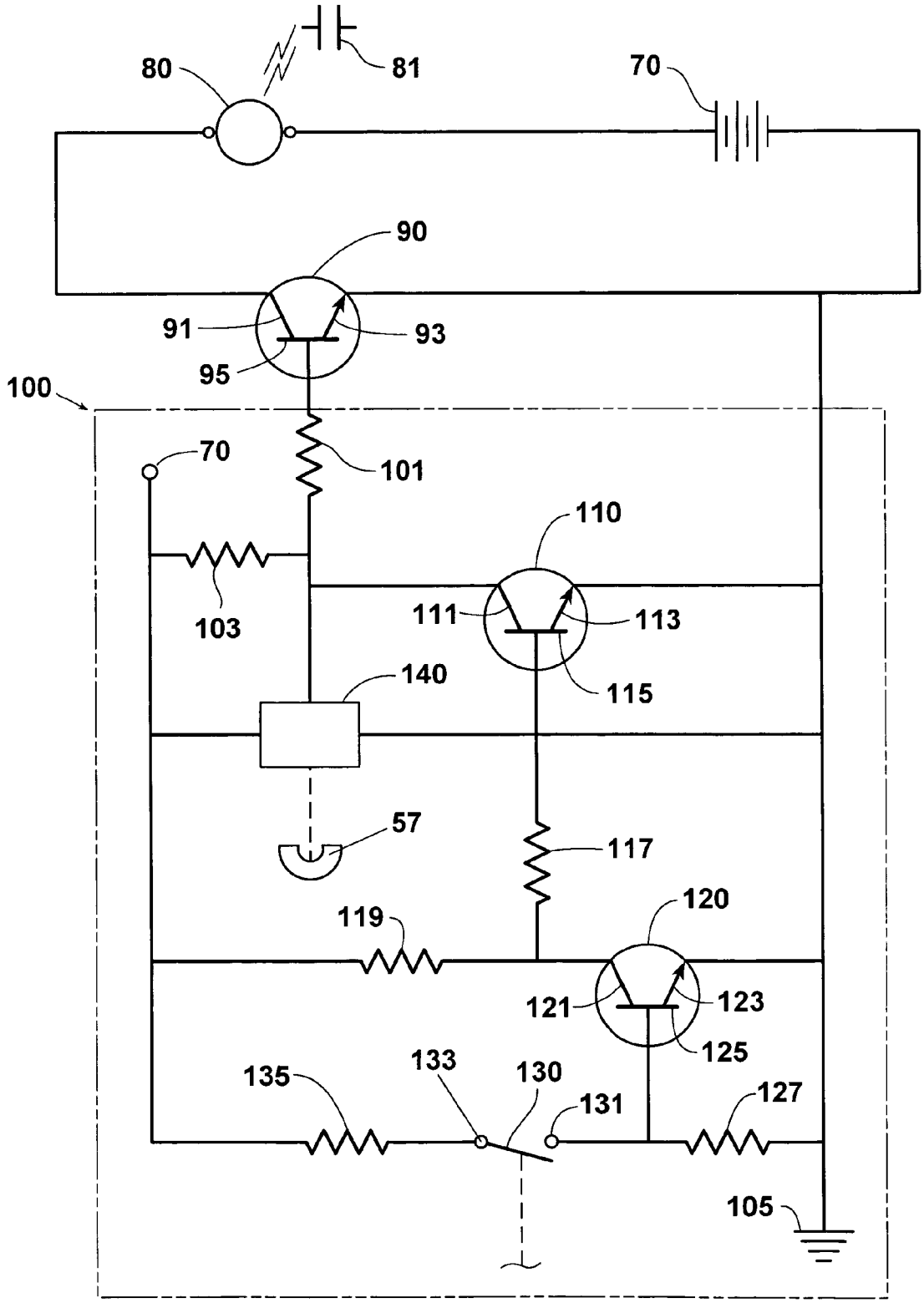
FIG. 7 is a schematic diagram of a preferred embodiment of the power and control circuits of the detector.

An electrical schematic diagram of a preferred embodiment of the drain plug absence detector is illustrated in FIGS. 7 and 8. The circuit includes a power source 70, such as the 12 volt battery normally used to power a boat's electrical system, a relay 80 with operating contacts 81 which will be used to switch an audio alarm circuit including a horn or bell or other audio device (not shown) already included in the boat or towing vehicle accessories and an on-off switch 90 for controlling the electrical connection of the power source 70 to the alarm relay 80. In the preferred embodiment illustrated in FIG. 7, the alarm on-off switch 90 is a grounded emitter transistor having its collector 91 and emitter 93 connected in series with relay 80 and the power source 70 and its base 95 connected to the switch control circuit 100.

The control circuit 100 uses a normally on grounded emitter transistor 110 and a normally off grounded emitter transistor 120, a normally open presence-of-water switch 130 and a Hall effect switch 140 or magnetic reed switch. The base 95 of the on-off transistor 90 is connected through a resistor 101 to the source 70 through a second resistor 103, to the Hall effect switch 140 and to the collector 111 of the normally on transistor 110. The Hall effect switch 140 is connected to the source 70 and to ground 105. The base 115 of the normally on transistor 110 is connected through a resistor 117 to the source 70 through another resistor 119 and to the collector 121 of the normally off transistor 120. The base 125 of the normally off transistor 120 is connected through a resistor 127 to ground 105 and to one contact 131 of the presence-of-water switch 130. The other contact 133 of the presence-of-water switch 130 is connected through a resistor 135 to the source 70. The presence-of-water switch 130, as shown in FIG. 8, closes in response to a bilge water switch 137 or other device which responds to the presence of water and/or closes in response to the electrical operation of a bilge pump 138 or other electrical device connected so as to be automatically energized in response to a presence of water.

In the operation of the control circuit 100, the resistor 127 connected to the base 125 of the normally off transistor 120 maintains the transistor 120 in its off condition. When the contacts 131 and 133 of the normally open presence-of-water switch 130 are closed, such as by operation of the bilge water switch 137 in the water 139 and/or the operation of the bilge pump 138 shown in FIG. 8, the resulting current to the base 125 turns on the normally off transistor 120. When the normally off transistor 120 is turned on, current through the resistor 117 connected to the base 115 of the normally on transistor 110 is diverted to ground 105 through the emitter 123 of the normally off transistor 120. Thus, the normally on transistor 110 is turned off. As a result, the resistor 101 connected to the base 95 of the on-off transistor 90 is no longer grounded and current is applied from the source 70 through the resistors 103 and 101 in the base circuit 95 of the on-off transistor 90. This turns on the on-off transistor 90, completing the power circuit to the alarm relay 80 to put the relay 80 into an in-connection condition. Thus, when the presence-of-water switch 130 is closed, the alarm relay 80 is always energized unless the presence of a magnetic field operates the Hall effect switch 140. If the Hall effect switch 140 operates, it connects the base 95 of the on-off switch 90 to ground 105, turning off the on-off switch 90 and disconnecting the power source 70 from the alarm relay 80 to put the relay 80 into an out-of-connection condition. When the Hall effect switch 140 is activated, the alarm relay is always de-energized whether or not the presence-of-water switch 130 is closed.

In a typical application using a 12 volt source 70, acceptable circuit component values would be:

| | |
|---|---|
| Transistors 90, 110 and 120 | MMST-A13 |
| Resistors 103, 119 and 135 | 10K |
| Resistors 101 and 117 | 100K |
| Resistor 127 | 1 MEG |

In assembling the device, the detector control circuit 100 slides into the cavity 15 of the receptacle 10 with connecting wires of the control circuit 100 extending outside of the cavity 15. Looking at FIG. 6, the device is mounted by filling the pocket 27 with silicon sealer and inserting the receptacle 10 into the drain D until the flange 23 abuts the stern S of the boat. Screws 65 inserted into the holes 29 in the flange 23 are driven into the stern S to secure the receptacle 10 in place in the drain D. The silicon in the pocket 27 seals the connection.

Figure 6:
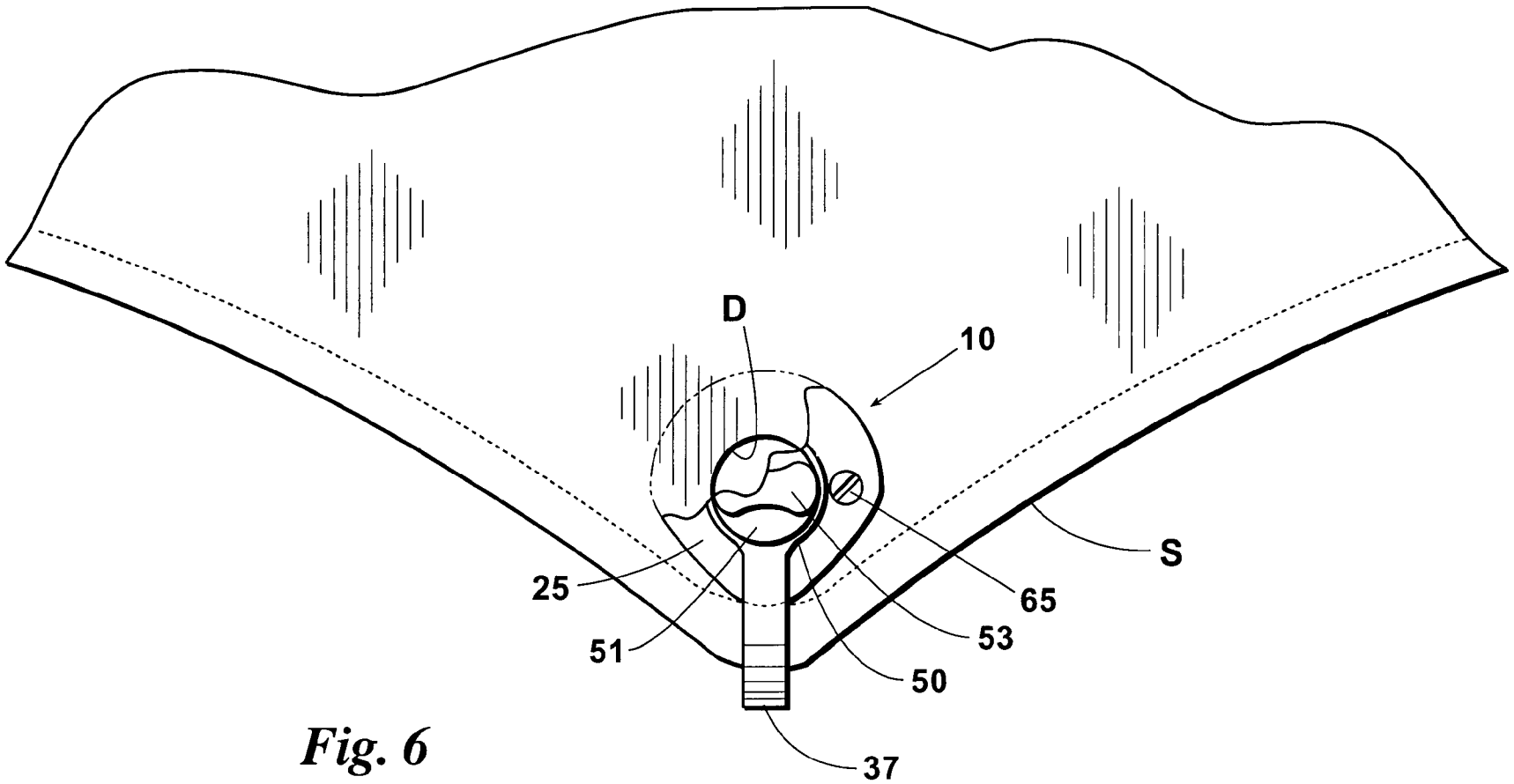
FIG. 6 is a rear elevation view illustrating the detector of FIG. 1 mounted in a boat drain hole.

The drain D is, as shown in FIG. 6, often located in the lowest part of the stern S at the keel of the boat. The tapered portion 25 of the flange 23 assists in contouring the receptacle 10 to the stern S. In the preferred embodiment, since the magnet 57 is coaxial and the control circuit housing 13 is chordal with respect to the centerline of the drain D, the control circuit 100 operates regardless of the orientation of the receptacle 10 in the drain D. However, if a different structural arrangement of these components is used in which the orientation of the Hall effect switch 140 in relation to the magnet 57 may impact circuit operation, it is desirable to be able to easily determine the relative orientation of the housing 13 and the magnet 57. The tapered portion 25 of the flange 23 and the contour of the grip 57 also serve this purpose.

Once the receptacle 10 is mounted in the drain D, the control circuit 100 is connected to the power source 70 and the relay 80. The relay contact 81 is connected in the audio alarm circuit (not shown) of the boat or towing vehicle. The presence-of-water switch 130 is operated by the bilge water switch 137 and/or the circuit of the bilge pump 138 as shown in FIG. 8. The stopper 50 is then screwed into the receptacle 10. The user need do nothing more to facilitate effective operation of the detector. If the boat is placed in a launch condition, that is if the boat is either in the process of being launched or has already been launched, if the stopper 50 is not present in the receptacle 10 when the float switch 130 closes, the control circuit 100 operates to close the on-off switch 90 and energize the alarm relay 80. However, if the stopper 50 is present in the receptacle 10, the juxtaposition of the magnet 57 with the Hall effect switch 140 will cause the control circuit 100 to maintain the on-off switch 90 in an opened condition, preventing the relay 80 and therefore the alarm from operating, whether or not the float switch 130 closes.

In its normal condition, the on-off switch 90 is opened and no load is imposed upon the power source 70. Furthermore, the only time that the on-off switch 90 will be closed is during the simultaneous occurrence of an absent stopper 50 and a closed float switch 130. The device is convenient to use because the stopper 50 can be inserted and removed from the receptacle 10 without getting into the boat.

It will be obvious to one skilled in the art that a wide variety of control circuits and switching mechanisms equivalent to the control circuit 100, the on-off switch 90 and the relay 80 may be employed. It is only essential that the on-off condition be determined by a normally closed switch which will be opened in response to the presence of the stopper 50 in the receptacle 10 and by a normally open switch which will be closed in response to the float switch 130. The invention has been described in relation to a drain hole in the stern of a boat but can be used in a drain hole located elsewhere in the hull.

Thus, it is apparent that there has been provided, in accordance with the invention, a drain plug absence indicator that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. Apparatus for indicating the absence of a drain plug in a boat drain when the boat is in a launch condition comprising:

a receptacle insertable into the drain, said receptacle having a water flow passage therethrough and a cavity therein, said cavity having a Hall effect switch and a switch operated in response to a presence-of-water condition contained therein; and a stopper insertable into said passage to prevent flow of water through said passage, said stopper having a magnet extending therefrom into operative alignment with said Hall effect switch when said stopper is fully inserted into said passage.

2. Apparatus for indicating the absence of a drain plug in a boat drain when the boat is in a launch condition comprising:

a control circuit having a Hall effect switch and a switch operated in response to a presence-of-water condition therein;

a receptacle insertable into the drain, said receptacle having a water flow passage therethrough and a cavity therein, said cavity containing said control circuit; and a stopper insertable into said passage to prevent flow of water through said passage, said stopper having a magnet oriented thereon for operative alignment with said Hall effect switch when said stopper is fully inserted into said passage.

3. Apparatus for indicating the absence of a drain plug in a boat drain when the boat is in a launch condition comprising:

a receptacle insertable into the drain, said receptacle having a water flow passage therethrough and a cavity therein;

a control circuit in said cavity, said control circuit having a Hall effect switch and a switch operated in response to a presence-of-water condition therein;

a stopper insertable into said passage to prevent flow of water through said passage, said stopper having a magnet oriented thereon for operative alignment with said Hall effect switch when said stopper is fully inserted into said passage;

means for activating an audio alarm; and means for switching said activating means into and out of electrical connection to a power source;

said control circuit driving said switching means between an activating means out-of-connection condition when said stopper is fully inserted into the drain and an activating means in-connection condition when said stopper is not fully inserted into the drain and said presence-of-water switch has operated.

4. Apparatus for indicating the absence of a drain plug in a boat drain when the boat is in a launch condition comprising:

a receptacle insertable into the drain, said receptacle having a cylindrically tubular portion defining a water flow passage from which extends a chordal tubular portion defining a cavity and a wall separating said passage from said cavity;

a control circuit in said cavity, said control circuit having a Hall effect switch and a switch operated in response to a presence-of-water condition therein;

a stopper insertable into said passage to prevent flow of water through said passage, said stopper having a magnet oriented thereon for operative alignment with said Hall effect switch when said stopper is fully inserted into said passage;

means for activating an audio alarm; and means for switching said activating means into and out of electrical connection to a power source;

said control circuit driving said switching means between an activating means out-of-connection condition when said stopper is fully inserted into the drain and an activating means in-connection condition when said stopper is not fully inserted into the drain and said presence-of-water switch has operated.

5. An apparatus according to claim 4, said receptacle further having a flange about said cylindrically tubular portion adapted to abut the boat when the receptacle is fully inserted into the drain.

6. An apparatus according to claim 5, said flange having an annular pocket adapted to abut the boat when the receptacle is fully inserted into the drain.

7. An apparatus according to claim 3, said stopper having a cylindrical plug insertable into said passage and said magnet having the shape of a rod and extending coaxially from one end of said plug.

8. An apparatus according to claim 7, said plug having a concentrically larger disc at another end thereof.

9. An apparatus according to claim 8, said disc having a finger grip extending therefrom in a direction opposite to said plug.

10. An apparatus according to claim 3 further comprising a strap, said receptacle being attached to one end of said strap and said stopper being attached to another end of said strap, at least a portion of said strap being sufficiently flexible to permit said stopper to be inserted into and removed from said receptacle.

11. Apparatus according to claim 3, said activating means comprising a relay.

12. Apparatus for indicating the absence of a drain plug in a boat drain when the boat is in a launch condition comprising:

a receptacle insertable into the drain, said receptacle having a threaded cylindrically tubular water flow passage therethrough with a chordal cavity extending therefrom and a wall separating said passage from said cavity;

a control circuit in said cavity, said control circuit having a Hall effect switch and a switch operated in response to a presence-of-water condition therein;

a stopper having a threaded cylindrical plug rotatably engagable in said threaded passage to prevent flow of water through said passage, said plug having a magnetic rod extending coaxially from one end thereof for operative alignment with said Hall effect switch when said plug is fully threaded into said passage;

means for activating an audio alarm; and means for switching said activating means into and out of electrical connection to a power source;

said control circuit driving said switching means between an activating means out-of-connection condition when said stopper is fully inserted into the drain and an activating means in-connection condition when said stopper is not fully inserted into the drain and said presence-of-water switch has operated.

13. Apparatus for indicating the absence of a drain plug in a boat drain when the boat is in a launch condition comprising:

a receptacle insertable into the drain, said receptacle having a water flow passage therethrough and a cavity therein, said cavity having a Hall effect switch and a control circuit contained therein; and a stopper insertable into said passage to prevent flow of water through said passage, said stopper having a magnet extending therefrom into operative alignment with said switch when said stopper is fully inserted into said passage said control circuit having another switch operated in response to a presence-of-water condition therein.

14. Apparatus for indicating the absence of a drain plug in a boat drain when the boat is in a launch condition comprising:

a receptacle insertable into the drain, said receptacle having a cylindrically tubular portion defining a water flow passage therethrough, a chordal tubular portion extending from said cylindrically tubular portion and defining a cavity therein, and a wall separating said passage from said cavity, said cavity having a Hall effect switch contained therein; and a stopper insertable into said passage to prevent flow of water through said passage, said stopper having a magnet oriented thereon for operative alignment with said switch when said stopper is fully inserted into said passage.

* * * * *